US006164846A

United States Patent [19]

Chatterjee et al.

[11] Patent Number: 6,164,846

[45] Date of Patent: Dec. 26, 2000

[54] APPARATUS AND METHOD FOR TRANSPORTING A WEB

[75] Inventors: Dilip K. Chatterjee; Syamal K. Ghosh, both of Rochester; Edward P. Furlani, Lancaster, all of N.Y.

[73] Assignee: Eastman Kodak Company, Rochester, N.Y.

[21] Appl. No.: 09/047,662

[22] Filed: Mar. 25, 1998

[51] Int. Cl.[7] ..... G03D 3/08

[52] U.S. Cl. ..... 396/612; 384/902

[58] Field of Search ..... 396/612, 620, 396/617, 646; 418/152; 384/902, 907.1

[56] References Cited

U.S. PATENT DOCUMENTS

| | | | |
|---|---|---|---|
| 3,817,618 | 6/1974 | Riley et al. | 355/100 |
| 4,255,038 | 3/1981 | Simon et al. | 396/630 |
| 4,544,253 | 10/1985 | Kummerl | 396/620 |
| 4,794,680 | 1/1989 | Meyerhoff et al. | 29/132 |
| 5,072,689 | 12/1991 | Nakagawa et al. | 384/902 |
| 5,083,873 | 1/1992 | Momose et al. | 384/907.1 |
| 5,407,601 | 4/1995 | Furey et al. | 252/51.5 |
| 5,458,794 | 10/1995 | Bardasz et al. | 252/56 R |
| 5,733,853 | 3/1998 | Bardasz et al. | 508/485 |
| 5,762,485 | 6/1998 | Ghosh et al. | 418/152 |
| 5,803,852 | 9/1998 | Agostinelli et al. | 474/161 |
| 5,824,123 | 10/1998 | Chatterjee et al. | 418/152 |

*Primary Examiner*—D. Rutledge
*Attorney, Agent, or Firm*—Clyde E. Bailey, Sr.; Stephen H. Shaw

[57] ABSTRACT

A web transport apparatus (10) useful for transporting web (16), such as photosensitive strips or sheets, in a corrosive materials environment has first and second rollers (12, 14) each having a sleeve portion (26, 36) with bushings (28, 38) and intermeshing gears (30, 40) arranged thereon. The sleeve portions (26, 36), gears (30, 40) and bushings (28, 38) each comprise a ceramic material that resist wear, abrasion and corrosion when exposed to the corrosive materials.

23 Claims, 2 Drawing Sheets

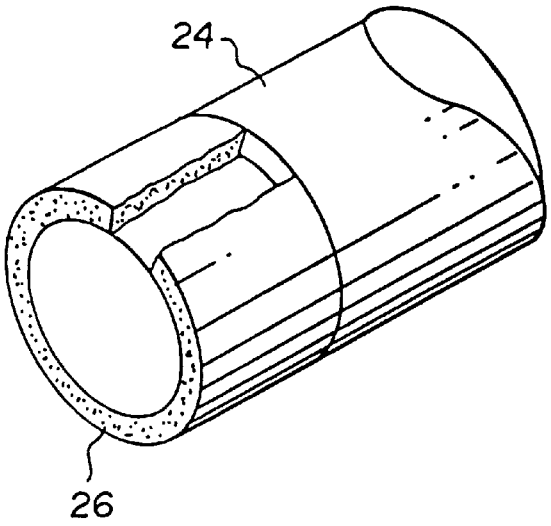
FIG. 2
FIG. 3a
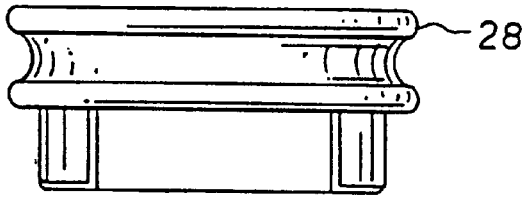
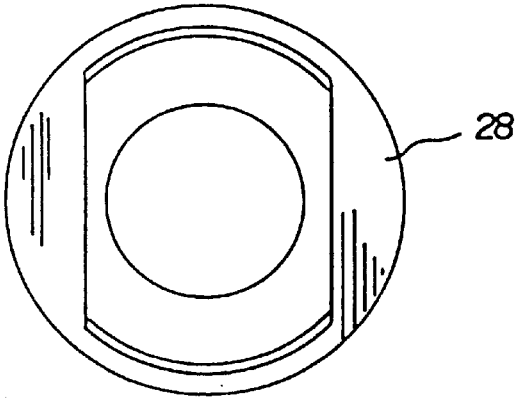
FIG. 3b
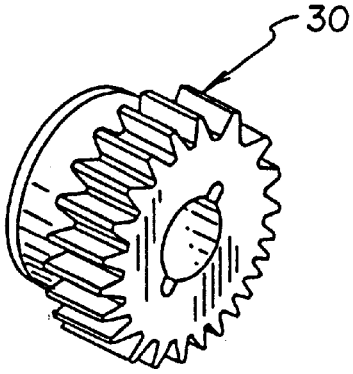
FIG. 4

APPARATUS AND METHOD FOR TRANSPORTING A WEB

CROSS-REFERENCE TO RELATED APPLICATIONS

This application is related to the following concurrently filed application: U.S. Ser. No. 09/047,842, entitled, "Apparatus For Processing Photographic Media" by Syamal K. Ghosh, Dilip K. Chatterjee, and Edward P. Furlani.

FIELD OF THE INVENTION

This invention relates to an apparatus and method for transporting web. More particularly, the invention concerns such apparatus having a combination of ceramic and non-ceramic bushing, gear and shaft assembly for transporting photosensitive webs, strips or sheets through processing stations containing corrosive film developing and fixing solutions.

BACKGROUND OF THE INVENTION

Conventional web converting equipment uses some sort of transport mechanism for moving the web at high rates of speeds through a series of processing stations. Typically such processing stations includes corrosive environments through which the web must be transported. For instance, in existing photographic film processors used to develop and fix photosensitive elements which are subjected to x-ray, visible and other radiation, the web is transported via a series of rollers defining a web transport path through a sequence of processing stations and then on to final processing in which the web is washed and then dried.

Moreover, process and transport apparatus for photosensitive or other media are other well known applications requiring a web transport mechanism. Such equipment may include automatic processing of the media for thermal, ink jet or silver halide-based photographic printing, and the like. The apparatus automatically transports sheets or webs or strips of photosensitive films, photosensitive papers or specially coated papers or plain papers. For photosensitive elements, this apparatus transports from a feed end of a film transport path, through a sequence of chemical processing tanks in which the media is developed, fixed, and washed, and then through a dryer to a discharge or receiving end. The processing equipment typically has a fixed film (media) path length, so final image quality depends on factors including transport speed which determines length of time the media is in solution, and the temperature and composition of the processing chemicals.

Generally speaking, majority of the components that are exposed to harsh chemicals in a photographic film processor or a thermal printer or an ink jet printer are made from AISI 300 series stainless steel or engineering plastic for reasons of mechanical strength, lower cost, and relatively good corrosion resistance. Engineering plastics are generally used as bushings and gears because of their relatively low coefficient of friction against stainless steel. Furthermore, photographic transport apparatus exposed in normal ambient conditions are also prone to wear and corrosion because of the abrasive and corrosive nature (depending on their relative humidity) of the photographic elements. Although stainless steel shafts have considerable strength and corrosion resistance, yet they are prone to wear with time and are also susceptible to corrosion when come in contact with harsh chemicals which are used in "fixer" solution for developing photographic films. Many engineering plastics are reinforced with glass and carbon fibers or other hard inorganic particles to improve the strength and wear resistance at the expense of proneness to corrosion. Another problem arises with plastic components in a fluid environment is that they tend to swell and become dimensionally unstable. For the reasons mentioned above, it is apparent that there is a need for materials which will endure the harsh chemical environments and at the same time will be compatible with other components of the system thereby enhancing the service life of the transport apparatus.

Experience indicates that structural ceramics like silicon carbide, alumina, zirconia and zirconia-alumina composites offer many advantages over conventional engineering materials, especially metals and plastics, to form bushings, gears and shafts, including many other ceramics and ceramic-metal composites (also referred to as cermets). It is to be noted that an ideal material combination for shafts bushings and gears is to be made so that the assemblage works synchronously and provides a longer service life. Many ceramics and cermets are hard and as a result are wear resistant. It is impossible to be speculative as to what material combinations would work functionally well as a bushing-shaft-gear assemblage. Although ceramic is relatively brittle, it can be used as a bushing in appropriate combination with other engineering materials. Alumina, alumina-toughened zirconia, zirconia and zirconia-toughened alumina ceramic sleeves over stainless steel shafts or solid ceramic shafts worked very well in conjunction with silicon carbide bushings. Incorporation of ceramic bushings in combination with ceramic shafts rendered the assemblage wear resistant and durable making the gear assembly the weakest link. It was surprisingly observed that precision ceramic gears made from Y-TZP or alumina-toughened zirconia were very compatible with the ceramic shaft-bushing assembly thereby making the assemblage more durable and efficient.

It is further known that a moving assemblage having a bearing surface in rotating contact with a stationary shaft or vice versa has a longer service life and better performance if made with not only a hard material but also the mating surfaces have low coefficient of friction.

It is also known that a gear assembly having sliding and rotating contact with the mating surfaces have a longer service life and a better performance if made with a hard material and the mating surfaces have low sliding (kinetic) coefficient of friction.

It is further known that a moving assemblage having a bearing surface in rotating contact with a stationary shaft or vice versa has a longer service life and better performance if made with not only a hard material but also the mating surfaces have low rotating (kinetic) coefficient of friction.

It is also know that a gear assembly having sliding and rotating contact with the mating surfaces have a longer service life and a better performance if made with a hard material and the mating surfaces have low coefficient of sliding or rotating friction.

As will be more completely disclosed, the method of our invention applies to a transport apparatus, i.e., a complete set of stationery bearing and rotating shaft made of ceramics or a complete set of rotating bushing and stationary shaft made of ceramics, particularly one member of assemblage made of silicon carbide. As will be more disclosed, the film processing equipment also utilizes ceramic gears made of Y-TZP and alumina-toughened zirconia (ATZ) ceramics. Proper choices of ceramics in manufacturing these bearings are essential to overcome the problems described above.

Therefore, a need persists for a media transport apparatus equipped with ceramic bushing/shaft assemblage that has superior wear and abrasion and corrosion resistance while being cost-effective and easy to manufacture. A need also persists to use ceramic gears in conjunction with ceramic bushing/shaft assemblage that has superior wear and abrasion and corrosion resistance and manufactured using net-shape technology.

SUMMARY OF THE INVENTION

It is, therefore, an object of the invention to provide a web transport apparatus that has a ceramic bushing, shaft, and gear assemblage that is reliable, simple to use and cost-effective to manufacture.

Another object of the invention is to provide a ceramic bushings assemblages having both a rotating shaft and stationary bushing or a stationary shaft and a rotating bushing.

It is yet another object of the invention to provide ceramic bushings comprising silicon carbide or silicon nitride that can be used as a stationary or a rotating member in a shaft/bushing assemblage.

Still another object of the invention is to provide an apparatus for transporting web having a ceramic shaft or a ceramic sleeve disposed on a metal shaft comprising alumina or zirconia-toughened alumina that can be used as a component for the rotating assemblage.

It is, therefore, a feature of the invention that ceramic gears comprising Y-TZP or zirconia-alumina composites are used as a component of the rotating assemblage of the web transport apparatus of the invention.

Accordingly, for accomplishing these and other objects, features and advantages of the invention, there is provided, in an aspect of the invention, a method of making ceramic bushings which includes the steps of providing ceramic powder comprising silicon carbide or silicon nitride. The ceramic bushing assemblage is complete when a shaft or journal formed of different ceramic material comprising alumina or zirconia-toughened alumina is disposed in the bore opening of the bearing for rotation about the interior wall. Alternatively, if the shaft is fixed, the interior wall of the bearing may rotate about the shaft. Furthermore, the ceramic gear assembly comprising yttria-alloyed zirconia or alumina-toughened zirconia is disposed in the opposite ends of the shafts.

In another aspect of the invention, a method for transporting web through a corrosive environment includes the step of providing a transport assemblage described above. The web can then be introduced through a transport nip between the closely space apart rollers and then be advanced by the rollers to and through one or more corrosive materials stations for processing.

It is, therefore, an advantage of the invention that the ceramic bushing, shaft and gear are reliable, easy to use, cost effective and efficient to practice. Moreover, bushings, shafts or sleeves and gears of the invention are inexpensive to produce, while having characteristically high wearability, easier manufacturability, and longer service life. Furthermore, an enormous advantage of the web transport apparatus and method of the invention is that they are not affected by the corrosive materials to which the web is exposed.

BRIEF DESCRIPTION OF THE DRAWINGS

The above mentioned and other objects, features and advantages of the invention and the manner of attaining them will become more apparent and the invention itself will be better understood by reference to the following description of an embodiment of the invention taken in conjunction with the accompanying drawings, wherein:

FIG. 2 is a cut-off perspective of the shaft-sleeve of the invention;

FIGS. 3*a* and 3*b* are the end and top plan views of the ceramic bushing of the invention; and FIG. 4 is a perspective of a ceramic gear of the invention.

DETAILED DESCRIPTION OF THE INVENTION

Figure 1:
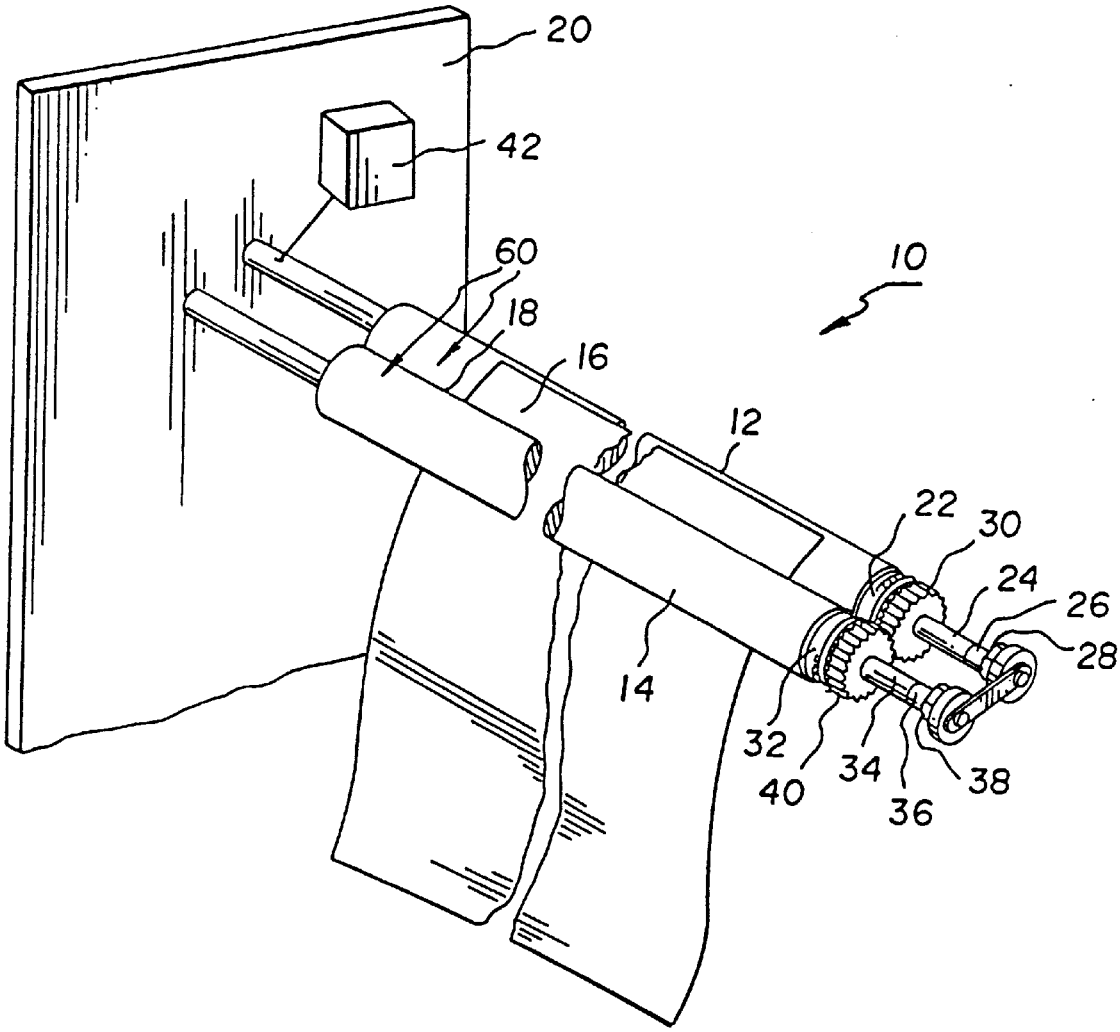
FIG. 1 is a perspective of the bushing, shaft-sleeve, and gear assembly.

Turning now to the drawings, and more particularly to FIG. 1, web transport apparatus 10, broadly defined, includes closely spaced apart first and second rollers 12, 14, alternately referred to as a squeegee-like roller assemblage 60 (described below). A web 16, such as photographic or x-ray films, photographic papers, specialty coated papers or plain papers can be introduced through the transport nip 18 formed by the spacing between the first and second rollers 12, 14 for advancing the web 16 to a downstream processing station (not shown). A rigid mounting means, such as a metal frame 20, supports first and second rollers 12, 14 for synchronous rotation.

In FIG. 1, first roller 12 has a first end portion 22 and a first shaft 24 extending from the first end portion 22. Further, first shaft 24 has a first sleeve portion 26 and a first bushing 28 arranged on first sleeve portion 26. Moreover, a first gear 30 is arranged on first shaft 24.

Referring again to FIG. 1, similarly second roller 14 comprises a second end portion 32 and a second shaft 34 extending from second end portion 32. Second shaft 34 has a second sleeve portion 36 and a second bushing 38 arranged on the second sleeve portion 36. For intermeshing with first gear 30 associated with first roller 12, a second gear 40 is mounted on second shaft 34 associated with second roller 14.

It is important to the apparatus of our invention that first and second sleeve portions 26, 36 each comprises a ceramic material selected from the group consisting of zirconia, alumina, zirconia-toughened alumina, and alumina-toughened zirconia and mixture thereof. We prefer using alumina for the sleeve portions 26, 36, discussed below.

Further, our invention contemplates that first and second bushings 28, 38 each comprises a ceramic material selected from the group consisting of: zirconia, silicon carbide, silicon nitride, alumina-toughened zirconia, and zirconia toughened alumina, and mixtures thereof. We prefer using silicon carbide for first and second bushings 28, 38, as indicated above, because of its compatibility with alumina used in first and second sleeve portions 26, 36.

Moreover, it is important to our invention that first and second gears 30, 40 each comprises a material selected from the group consisting of: zirconia, alumina toughened zirconia, plastic, and metal. We prefer yttria stabilized zirconia as the gear material.

Referring again to FIG. 1, apparatus 10 includes some sort of drive means, such as a motor 42, operably connected to any one of the first and second rollers 12, 14 for driving at least one of the first and second rollers 12, 14. Synchronous rotation of the other of the first and second rollers 12, 14 is produced by the driven roller. As any skilled artisan will appreciate, this rotation of the first and second rollers 12, 14 causes the web 16 to be advanced through the transport nip 18.

According to FIG. 1, squeegee-like roller assemblage 60 are synchrously rotated by meshing gears 30, 40, described below, which are fitted over shafts 24, 34, extending from the roller end portions 22, 32. If the shafts 24, 34 are selected to be stainless steel, about both ends of the shafts where the ceramic bushings 28, 38 reside are provided with ceramic sleeves 26, 36.

Referring to FIG. 2, ceramic sleeves 26, 36 are shrunk fit over stainless steel shafts 24, 34 (only one sleeve and one shaft is shown). The sleeve is the most cost effective way of providing a better performance because the ceramic busing will be riding on that surface only. Alternatively, the entire shaft can be made using ceramic also. The sleeve is made from 99.9% pure alumina (ALCOA grade A-16SG) having particle size ranging from 0.5 to 2.0 $\mu$m. The sleeves were made using cold isostatic pressing. Alternatively the sleeves can also be made using dry pressing or injection molding processes. The green ceramics were sintered at 1550° C. for 2 hours. The sintering schedule will be disclosed more fully.

Referring to FIGS. 3*a* and 3*b*, ceramic bushing 28 is shown (bushing 38 is identical and is not shown) which rides over the ceramic sleeve portions 26, 36 (FIG. 1) of the shaft. The bushing is made from 99.99% pure silicon carbide having particle size ranging from 1 to 10 $\mu$m. SiC billets were formed first by using cold isostatic pressing followed on by green machining. The green parts were sintered at 1800° C. for 1 to 3 hours in vacuum or in a neutral or a nonoxidizing atmosphere. The bushings can also be made from silicon nitride. The sintering schedule for SiC and $Si_3N_4$ will be disclosed more fully.

Referring to FIG. 4, ceramic gear 30 is shown (gear 40 is identical and is not shown). The gear is made from yttria-alloyed zirconia using dry pressing or injection molding process. The zirconium oxide alloy consists essentially of zirconium oxide and a secondary oxide selected from the group consisting of MgO, CaO, $Y_2O_3$, $Sc_2O_3$, and rare earth oxides. Moreover, the zirconium oxide alloy has a concentration of the secondary oxide of, in the case of $Y_2O_3$, about 0.5 to about 5 mole percent; in the case of MgO, about 0.1 to about 1.0 mole percent, in the case of $CeO_2$, about 0.5 to about 15 mole percent, in the case of $SC_2O_3$, about 0.5 to about 7.0 mole percent and in the case of CaO from about 0.5 to about 5 mole percent, relative to the total of said zirconium oxide alloy, said compacting further comprising forming a blank. Alternatively, alumina-toughened zirconia, wherein $Al_2O_3$ concentration varies from 5 to 50 weight %, preferably from 10 to 30 weight %, and most preferably about 20 weight %, can be used in $ZrO_2$—$Al_2O_3$ ceramic mixture. A mold is provided for receiving and processing the ceramic powder. In this embodiment of the invention, after the initial shaping, the green ceramic gear is sintered thereby forming a sintered net-shape ceramic gear, as described more fully below.

Ceramic Powder Mixing

Ceramic powders comprising SiC, preferably $\alpha$-SiC, $Si_3N_4$, $Al_2O_3$ and $Al_2O_3$—$ZrO_2$ composites are obtained commercially from various vendors. Generally, sintering aids are often added for powders like SiC and $Si_3N_4$ to obtain full density after sintering. Trace quantity (not exceeding 2 weight %) B or $Al_2O_3$ are used as sintering aids for SiC and generally MgO is used for $Si_3N_4$ in the powder and ball milled and then spray dried with an organic binder like PVA or PEG or acrylic to aid in compacting the ceramic powder in a mold. Control of particle size, particle size distribution, and chemical purity of the ceramic powder are very important to obtain the most optimum physical and mechanical properties of the sintered ceramics. It is preferred that the ceramic powders have small particle size in the range of 1 to 5 $\mu$m, average being 2 $\mu$m and the impurity level should not exceed 1 weight %.

Zirconia Powder Mixing

More particularly, we prefer using tetragonal zirconia ceramic material for manufacturing a gear in a cost effective way. The most preferred material which we prefer using is essentially zirconia having 100% tetragonal crystal structure. We developed this 100% tetragonal zirconia by alloying zirconia with a number of secondary oxides as described in U.S. Pat. No. 5,336,282 and U.S. Pat. No. 5,358,913, hereby incorporated herein by reference.

The preferred ceramic powder mixture most preferred in the method of making zirconia-alumina composites of the invention includes a particulate alumina and particulate alloys of $ZrO_2$ and additional "secondary oxide" selected from: MgO, CaO, $Y_2O_3$, $Sc_2O_3$ and $Ce_2O_3$ and other rare earth oxides (also referred to herein as "Mg-Ca-Y-Sc-rare earth oxides"). Zirconia alloys useful in the methods of the invention have a metastable tetragonal crystal structure in the temperature and pressure ranges at which the ceramic article produced will be used. For example, at temperatures up to about 200° C. and pressures up to about 1000 MPa, zirconia alloys having, wherein zirconium oxide alloy has a concentration of said secondary oxide of, in the case of $Y_2O_3$, about 0.5 to about 5 mole percent; in the case of MgO, about 0.1 to about 1.0 mole percent, in the case of $CeO_2$, about 0.5 to about 15 mole percent, in the case of $Sc_2O_3$, about 0.5 to about 7.0 mole percent and in the case of CaO from about 0.5 to about 5 mole percent, relative to the total of said zirconium oxide alloy, said compacting further comprising forming a blank, exhibit a tetragonal structure. Preferred oxides for alloying with zirconia are $Y_2O_3$, MgO, CaO, $Ce_2O_3$ and combinations of these oxides. It is preferred that the zirconia powder have high purity, greater than about 99.9 percent. Specific examples of useful zirconia alloys include: tetragonal structure zirconia alloys having from about 2 to about 5 mole percent $Y_2O_3$, or more preferably about 3 mole percent $Y_2O_3$. Examples of tetragonal structure zirconia alloys useful in the methods of the invention are disclosed in U.S. Pat. No. 5,290,332. Such zirconia alloys are described in that patent as being useful to provide a "net-shape" ceramic article: a ceramic article that is dimensionally true after sintering and therefore does not necessitate further machining prior to use in its intended working environment.

Compacting

Turning now to compacting ceramic powder is cold compacted using preferably an isostatic press to provide an unsintered blank which is alternatively referred to herein as a "green preform". It should be apparent to skilled artisans that a particular method of compacting the powder is not critical. The terms "cold compaction" and the like refer to compression of the particulate mixture at a temperature below glass transition or decomposition temperature of the organic binder. The green preform can be produced by such methods as cold uniaxial pressing, cold isostatic pressing, injection molding or cold extrusion. The particulate mixture is preferably subjected to uniform compacting forces in order to provide a unsintered blank which has a uniform density.

The particulate mixture of silicon carbide or silicon nitride or alumina or zirconia-alumina composite is compacted; heated to a temperature range at which sintering will occur; sintered, that is, maintained at that temperature range for a period of time; and then cooled. For example, compaction and sintering can be simultaneous in a single operation or partial compaction can be followed by sintering and further compaction. The interim product of compacting and sintering operations is referred to herein as a "blank".

In a preferred method of the invention, the powder is cold compacted to provide a "green preform", which has a "green" density that is substantially less than the final sintered density of the ceramic article. It is preferred that the green density be between about 40 and about 65 percent of the final sintered density, or more preferably be about 55 percent of the final sintered density.

Sintering

Silicon Carbide and Silicon Nitride:

Sintering of the green silicon carbide and silicon nitride bushings is performed in a temperature range from about 1600° C. to about 1850° C., or more preferably at about 1800° C. Preferable sintering times is in the range from about 1 hour to about 3 hours, or more preferably, about 2 hours. In a particular embodiment of the methods of the invention, the sintering peak temperature is 1800° C. and that temperature is maintained for about 2 hours. It is preferred that the pre-sintered bushing be slowly heated to the sintering temperature and slowly cooled in a vacuum or neutral environment so as to avoid undesirable oxidation, dimensional changes, distortions and crack development. In an embodiment of the invention having a preferred sintering temperature of 1800° C., preferred temperature ramps during heating are: about 1° C./minute from room temperature to about 300° C., about 2° C./minute for about 300° C. to about 400° C., about 4° C./minute for about 400° C. to about 600° C., and about 5° C./minute for about 600° C. to about 1800° C. Preferred temperature ramps during cooling are: about 4° C./minute for about 1800° C. to about 800° C. and about 8° C./minute for about 800° C. to room temperature.

Alumina, Zirconia and Alumina-zirconia Composite:

Sintering of the cold isostatically pressed and green machined or dry pressed or injection molded alumina, zirconia or zirconia-toughened alumina or alumina-toughened zirconia shafts or shaft sleeves or bushings is performed in a temperature range of about 1400° C. to about 1600° C., Similarly, sintering of the dry pressed or injection molded yttria-alloyed zirconia or alumina-toughened zirconia is performed in a temperature range of about 1400° C. to about 1600° C. The parts which are injection molded are generally subjected to a debinding process at a temperature higher than the glass transition temperature of the binder prior to sintering.

Alternatively, sintering may be achieved in the presence of a dopant selected from: MgO, FeO, ZnO, NiO, and MnO, and combination thereof, as discussed below in detail. The resulting sintered zirconia article of the invention has a core comprising tough tetragonal phase and a case comprising hard cubic phase. The resulting alumina-zirconia ceramic article of the invention has a core of a-alumina or a-alumina and tetragonal zirconia alloy and a case of cubic spinel or cubic spinel along with cubic structure or cubic and monoclinic structure of zirconia alloy. This doping process is particularly beneficial for forming gears because the resulting case (outer surface) of the gears is hard which withstand more abrasion and wear and the core of the gear is relatively tough to endure the applied stress.

In the sintering of the methods of the invention, the dopant oxide selected from: MgO, FeO, ZnO, CoO, NiO, and MnO, and combination thereof, is in contact with the blank. It is preferred that the sintering results in a ceramic article like bushing or shaft sleeve or gear having a "full" or nearly theoretical density, and it is more preferred that the density of the said ceramic articles be from about 99.5 to about 99.9 percent of theoretical density. Sintering is conducted in air or other oxygen containing atmosphere.

The methods of the invention are not limited to any particular sintering pressure and temperature conditions. Sintering can be performed at atmospheric pressure or alternatively a higher pressure can be used during all or part of the sintering to reduce porosity. The sintering is continued for a sufficient time period for the case of the article being sintered to reach a thermodynamic equilibrium structure. An example of a useful range of elevated sintering pressures is from about 69 MPa to about 207 MPa, or more preferably about 100–103 MPa.

The exact manner in which the dopant is in contact with the blank during sintering is not critical, however, the "case", as that term is used herein, is limited to those areas of the blank in contact with the dopant during sintering. For example, a cubic spinel and tetragonal zirconia case can be readily produced by the methods of the invention on a portion of the overall surface of an article. It is not critical that the dopant be in contact with the blank during initial sintering, that is, sintering which does not result in an increase in density to full density.

Shaping/Machining

It is known that ceramic parts can be fabricated to net-shape by the compaction processes such as dry pressing, injection molding, slip casting, and cold isostatic pressing accompanied by green machining. Green machining refers to the process of machining the ceramic particulate compact prior to densification. (For more general information refer to David W. Richerson, Modern Ceramic Engineering: Properties, Processes and Use in Design, 2nd Edition (1992). In this process, it is important that care be exercised to avoid overstressing the fragile material and producing chips, cracks, breakage, or poor surface. For instance, it is important that the ceramic billet is held rigidly, but with no distortion or stress concentration, during green machining. The part can be rigidly held by one of a numerous ways, including by simple mechanical gripping, by bonding or potting with a combination of beeswax and precision metal fixtures, the latter being preferred by the inventors. Once the ceramic billet is secured rigidly in a fixture, green machining can be accomplished in a variety of methods, including: turning, milling, drilling, form wheel grinding, and profile grinding. We prefer turning and profile grinding the billet during green machining to achieve the best results. Machining can be either dry or wet, depending on the binder present and whether or not the part has been bisque fired, i.e., fired at a high enough temperature to form bonds at particle-particle contact points, but not at a high enough temperature to produce densification.

Apart from green machining, a further precision machining step of some of the surfaces of a sintered ceramic is required to meet dimensional tolerances, achieve improved surface finish or remove surface flaws. Maintaining dimensional tolerances to the extent of few millionths of an inch or achieving surface finish to less than 10 microinches is not possible unless final machining after sintering is undertaken.

The invention has been described in detail with particular reference to certain preferred embodiments thereof, but it will be understood that variations and modifications can be effected within the spirit and scope of the invention.

PARTS LIST

10 web transport apparatus
12 first roller
14 second roller
16 web
18 transport nip
20 metal frame
22 first roller end portion
24 first shaft
26 first sleeve
28 first bushing
30 first gear
32 second roller end portion
34 second shaft
36 second sleeve
38 second bushing
40 second gear
42 drive motor
60 squeegee-like roller assembly

What is claimed is:

1. Web transport apparatus, comprising:

a mounting means;

first and second rollers mounted for synchronous rotation in said mounting means, said first and second rollers being closely spaced apart to form a transport nip therebetween, said first roller comprising a first end portion and a first shaft extending from said first end portion, said first shaft having a first sleeve portion, a first bushing arranged on said first sleeve portion and a first ceramic gear; and said second roller comprising a second end portion and a second shaft extending from said second end portion, said second shaft having a second sleeve portion, a second bushing arranged on said second sleeve portion and a second ceramic gear; said first and second ceramic gears being arranged on said first and second shafts, respectively, for intermeshig with one another; wherein said first and second sleeve portions each comprises a ceramic matenal selected from the group consisting of zirconia, alumina, zirconia-toughened alumina, and alumina-toughened zirconia and mixture thereof; and, wherein said first and second bushings each comprises a ceramic material selected from the group consisting of: zirconia, silicon carbide, silicon nitride, alumina-toughened zirconia, and zirconia-toughened alumina; and wherein said first and second ceramic gears each comprises a material selected from the group consisting of: zirconia, alumina toughened zirconia; and, a drive means operably connected to any one of said first and second rollers for driving at least one of said first and second rollers thereby causing the synchronous rotation of the other of said first and second rollers, whereby rotation of said first and second rollers causes said web to be advanced through said transport nip.

2. The apparatus recited in claim 1, wherein said first and second sleeve portions each comprises alumina ceramic; and said first and second bushings comprise zirconia ceramic.

3. The apparatus recited in claim 1, wherein said first and second sleeve portions each comprises zirconia-toughened alumina; and said first and second bushings comprise alumina ceramic.

4. The apparatus recited in claim 1, wherein said first and second sleeve portions each comprises alumina ceramic; and said first and second bushings comprise silicon carbide.

5. The apparatus recited in claim 1, wherein said first and second sleeve portions each comprises alumina ceramic; and said first and second bushings comprise silicon nitride.

6. The apparatus recited in claim 1, wherein said first and second sleeve portions each comprises alumina-toughened zirconia; and said first and second bushings comprise silicon carbide.

7. The apparatus recited in claim 1, wherein said first and second sleeve portions each comprises alumina-toughened zirconia; and said first and second bushings comprise silicon nitride.

8. The apparatus recited in claim 3, wherein said zirconia-toughened alumina has a toughness in the range of about 8 to 10 $Mpam^{1/2}$.

9. The apparatus recited in claim 4, wherein said alumina-toughened zirconia has a toughness in the range of about 8 to 12 $Mpam^{1/2}$.

10. The apparatus recited in claim 1, wherein said first and second ceramic gear each comprises yttria-stabilized zirconia.

11. The apparatus recited in claim 1, wherein said first and second ceramic gear each comprises alumina-toughened zirconia.

12. Web transport apparatus, comprising:

a mounting means;

first and second rollers mounted for synchronous rotation in said mounting means, said first and second rollers being closely spaced apart to form a transport nip therebetween, said first roller comprising a first end portion and a first shaft extending from said first end portion, said first shaft having a first ceramic portion, a first bushing arranged on said first ceramic portion and a first ceramic gear; and said second roller comprising a second end portion and a second shaft extendong from said first and second end portion, said second shaft having a second cramic portion, a second bushing arranged on said second ceramic portion and a second ceramic gear; said first and second ceramic gears being arranged on said first and second shafts, respectively, for intermeshing with one another, wherein said first and second ceramic end portions of said first and second shafts, respectively, each comprises a ceramic material selected from the group consisting of zirconia, alumina, zirconia-toughened alumina, and alumina-toughened zirconia and a mixture thereof; and, wherein said first and second bushings each comprises a ceramic material selected from the group consisting of: zirconia, silicon carbide, silicon nitride, alumina-toughened zirconia, and zirconia-toughened alumina; and wherein said first and second ceramic gears each comprises a material selected from the group consisting of: zirconia, alumina toughened zirconia; and, a drive means operably connected to any one of said first and second rollers for driving at least one of said first and second rollers thereby causing synchronous rotation of the other of said first and second rollers, whereby rotation of said first and second rollers causes said web to be advanced through said transport nip.

13. The apparatus recited in claim 12, wherein said first and second ceramic portions each comprises alumina ceramic; and said first and second bushings each comprises zirconia ceramic.

14. The apparatus recited in claim 12, wherein said first and second ceramic portions each comprises zirconia-toughened alumina; and said first and second bushings comprise alumina ceramic.

15. The apparatus recited in claim 12, wherein said first and second ceramic portions each comprises alumina ceramic; and said first and second bushings comprise silicon carbide.

16. The apparatus recited in claim 12, wherein said first and second ceramic portions each comprises alumina ceramic; and said first and second bushings comprise silicon nitride.

17. The apparatus recited in claim 12, wherein said first and second ceramic portions each comprises alumina-toughened zirconia; and said first and second bushings comprise silicon carbide.

18. The apparatus recited in claim 12, wherein said first and second ceramic portions each comprises alumina-toughened zirconia; and said first and second bushings comprise silicon nitride.

19. The apparatus recited in claim 14, wherein said zirconia-toughened alumina has a toughness in the range of about 8 to 10 $Mpam^{1/2}$.

20. The apparatus recited in claim 15, wherein said alumina-toughened zirconia has a toughness in the range of about 8 to 12 $Mpam^{1/2}$.

21. The apparatus recited in claim 12, wherein said first and second ceramic gears each comprises yttria-stabilized zirconia.

22. The apparatus recited in claim 12, wherein said first and second ceramic gears each comprise alumina-toughened zirconia.

23. A method of transporting web in a corrosive environment, comprising the steps of:

providing an environment containing corrosive materials to which the web is exposed;

providing at least one web transport apparatus recited in claim 1;

providing a source of web;

introducing the web into the transport nip of the first and second rollers; and, activating at least one of the rollers in the at least one web transport assemblage for causing synchronous movement of the other roller thereby forcing the web to advance forwardly in the direction of the rotation of the rollers and then through the corrosive materials environment.

* * * * *